US006543360B2

(12) United States Patent
Sasaki et al.

(10) Patent No.: US 6,543,360 B2
(45) Date of Patent: Apr. 8, 2003

(54) PRINTING PLATE AND PRINTER USING IT

(75) Inventors: Hiroshi Sasaki, Mlto (JP); Mitsuyoshi Shouji, deceased, late of Jyuo (JP), by Sachiko Shouji, legal representative; Kenichi Kawashima, Hitachinaka (JP); Yutaka Ito, Takahagi (JP); Teruaki Mitsuya, Naka (JP); Nobuyoshi Hoshi, Hitachinaka (JP)

(73) Assignees: Hitachi, Ltd., Tokyo (JP); Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/748,864

(22) Filed: Dec. 28, 2000

(65) Prior Publication Data

US 2001/0006028 A1 Jul. 5, 2001

(30) Foreign Application Priority Data

Dec. 28, 1999 (JP) ..... 11-372684

(51) Int. Cl.[7] ..... B41N 1/14; B41N 3/08; B41C 1/10

(52) U.S. Cl. ..... 101/453; 101/457; 101/465; 101/466; 101/478; 101/450.1

(58) Field of Search ..... 101/141, 450.1, 101/451, 457, 462, 463.1, 465, 466, 478, 423, 424, 425, 453

(56) References Cited

U.S. PATENT DOCUMENTS 4,718,340 A * 1/1988 Love, III ..... 101/141
5,165,343 A * 11/1992 Inoue et al. ..... 101/463.1
5,848,332 A * 12/1998 Machida ..... 101/463.1
6,006,666 A * 12/1999 Gottling ..... 101/425
6,087,072 A * 7/2000 Sasaki et al. ..... 101/453

FOREIGN PATENT DOCUMENTS

JP 59-201899 * 11/1984 ..... 101/465
JP 8-310101 * 11/1996
JP 10-114888 * 5/1998

OTHER PUBLICATIONS

"Rewritable Imaging Plate Consisting of Super–in–repellant Surface and its Application for New Variable Printing", H. Sasaki et al, J. of Japanese Society of Printing, vol. 38, pps. 317–321 (2001).

"Control of Hydrophobic Property of Super–Water–Repellant Surface", H. Sasaki, Chemical Sensors, vol. 17, No. 4, pp. 137–142 (2001).

* cited by examiner

*Primary Examiner*—Stephen R. Funk
(74) *Attorney, Agent, or Firm*—Antonelli, Terry, Stout & Kraus, LLP

(57) ABSTRACT

A printing system is provided which ensures easy formation of a plate and regeneration of the plate for continued use. The press plate used in a the printing system to form an image using a water-based ink is characterized in that, (I) prior to formation of a latent image, the surface forming the latent image exhibits extra ink-repellency to the ink to be used; (2) the press plate allows a water soluble material forming the latent image to be deposited thereon; (3) the latent image can be formed by allowing the water soluble material to be deposited on the press plate surface; and (4) the press plate can be regenerated as a plate which allows a new latent image to be formed by washing the press plate with water and drying it, upon completion of ensuing processes of development and transfer.

6 Claims, 3 Drawing Sheets

CROSS SECTION
VIEWED FROM SIDE

TOP VIEW

PRINTING PLATE AND PRINTER USING IT

BACKGROUND OF THE INVENTION

The present invention relates to a printer using water-based ink and a printing plate used in said printer.

The Official Gazette of Japanese Patent Laid-Open NO. 310101/1996 discloses that a patterned water-based ink layer is formed by feeding water-based ink to a plate having an ink repellent substance in a non-printing area, and the patterned water-based ink layer is then transferred to the object to be printed. The Official Gazette of Japanese Patent Laid-Open NO. 228066/1995 discloses that a non-water-soluble zinc compound powder provided with hydrophilic treatment is used as a component of an image receiving layer for a direct plotting offset printing plate.

A gravure printing printer or offset printing printer provides high-speed volume printing of advertisement fliers and books having identical images. However, such a machine has problems when handling images for a low volume production with a wide variety of types; namely, much time and cost are required to form the plate, and the plate cannot be recovered. An innovative idea, including the invention of a printing method and a printer allowing recovery of a plate, has been required to achieve effective production of printed matter in volumes of hundreds to thousands of copies required.

The object of the present invention is to provide a printer which ensures easy formation of a plate and recovery of the plate, and to a printing plate.

SUMMARY OF THE INVENTION

The inventors of the present invention have studied many types of printing methods and have come to the conclusion that the above object can be achieved if a once used plate can be recovered, so that the plate forming process can be reduced. Thus, they have studied various methods of facilitating plate formation, and have found that it is possible to manufacture a system which can achieve the above object by using water-based ink and a super-ink-repellent plate, and by utilizing a water soluble material for formation of a latent image.

The following is a specific description of our invention: The term "super-ink-repellent surface" appearing in this Specification means that the surface does not allow deposition of a drop of ink equal to or greater in size than the minimum size of a dot in the printing process. The minimum dot size of the printer used in the embodiments was 10 microns. In this Specification, this surface is defined as a surface which repels a drop of ink having a size greater than that, namely, 10 microns or more, when said surface is brought in contact with said ink. Furthermore, the term "water soluble material" used in this Specification is defined as a substance which is 100% infinitely diluted with water at normal temperature and deposits on the super-ink-repellent surface.

(1) A printing plate used in a printer to form an image using water-based ink is characterized in that, prior to formation of a latent image, the surface forming the latent image exhibits super-ink-repellency to the used ink; said printing plate allows a water soluble material forming the latent image to be deposited thereon; the latent image can be formed by allowing said water soluble material deposited on said printing plate surface; and said printing plate can be recovered as a plate which allows a new latent image to be formed by washing said printing plate with water and drying it, upon completion of ensuing processes of development and transfer.

(2) A printer comprises at least a plate; a mechanism forming a latent image on said plate; a mechanism allowing ink to be deposited and developed on said plate where the latent image is formed; and a mechanism to transfer said developed image onto paper; and said ink is water-based ink. The printer is characterized in that prior to formation of a latent image, the surface of the plate exhibits super-ink-repellency to the used ink; said printing plate allows a water soluble material forming the latent image to be deposited thereon; the latent image can be formed by allowing said water soluble material deposited on said printing plate surface on said plate surface; and a mechanism is provided to permit said printing plate to be recovered as a plate which allows a new latent image to be formed thereon upon completion of ensuing processes of development and transfer. The mechanism contains at least a device to remove ink deposited on said plate and a device to dry said plate.

(3) The printer is characterized in that a mechanism to heat said plate or transfer mechanism is provided inside said plate and transfer mechanism.

(4) The printer is characterized in that a mechanism to suck waste water generated in said washing step.

DETAILED DESCRIPTION OF THE INVENTION

Figure 1:
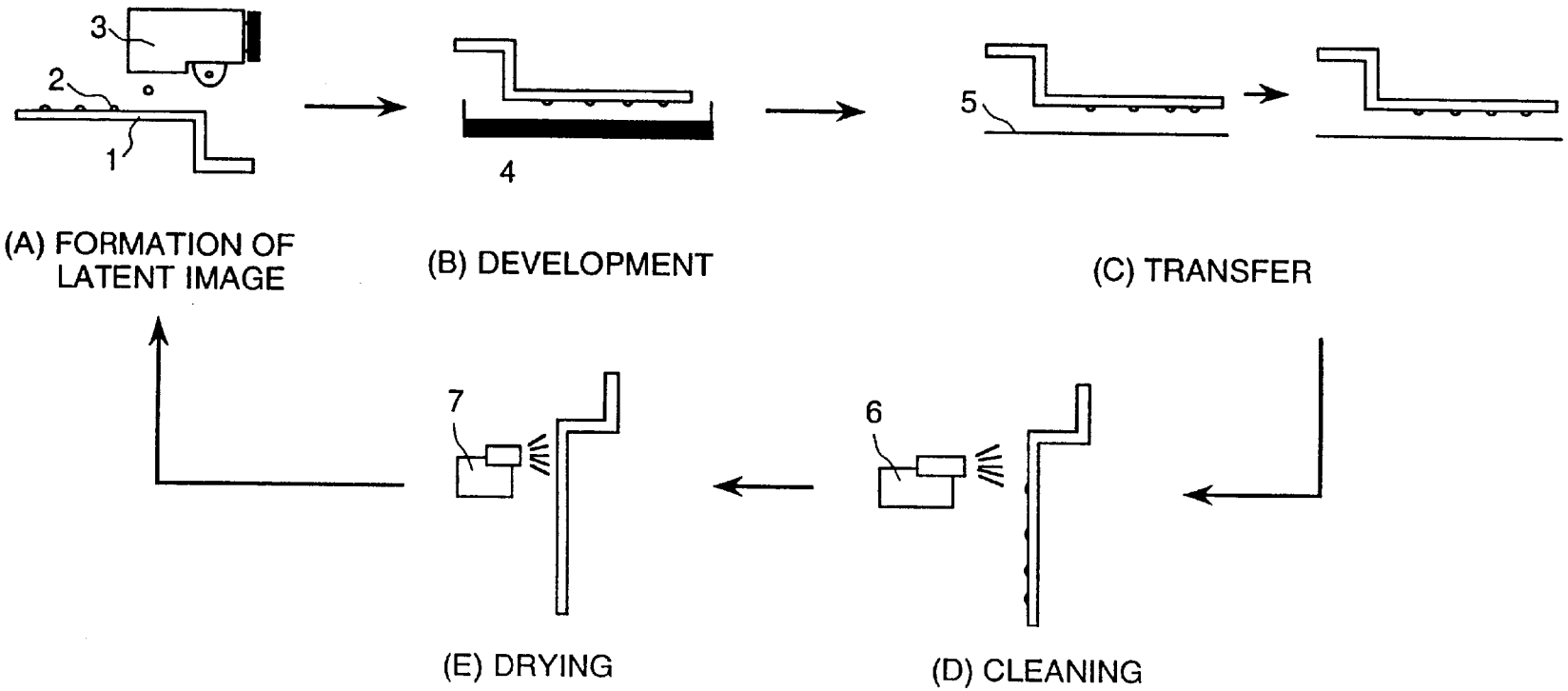
FIG. 1 is a process flow diagram illustrating how to form an image according to the present invention.

FIG. 1 shows the method of forming an image using a printing plate according to the present invention. The process flows in the following order: Formation of latent image on a plate 1, development and transfer. The surface of plate 1 where a latent image is formed exhibits super-ink-repellency to the ink to be used. Formation of a latent image comprises a step of depositing water soluble material 2 onto the ink-coated portion of the plate surface. The plate surface allows water soluble material 2 to be deposited thereon. FIG. 1 shows that the water soluble material is ejected from the nozzle of a head 3 for latent image formation by an ejecting method to be discussed later and is deposited onto the plate surface. It should be noted that the method of depositing the water soluble material is not restricted to this method alone. In the development phase, plate 1 is dipped into a pad 4 filled with ink. Then water-based ink is deposited only onto the portion of the surface of plate 1 where the water soluble material 2 is deposited. The transfer phase is a step of shifting the image, formed by the ink on the plate, onto the paper 5. The process of printing is now complete. After printing, ink remains on the ink-deposited portion as a latent image since super-ink-repellency is lost. When multiple printed copies having the same image are to be printed, only the steps of development and transfer are repeated since the latent image is already formed on the plate 1 for the second copy and thereafter.

Furthermore, by providing a step of recovering the plate 1, it is possible to provide a plate which can be used again, similarly to the organic photoconductor of a laser printer. Ink and a very small amount of water soluble material 2 used for the formation of the latent image remain on the plate 1 after the printing of a required number of copies has been completed.

Furthermore, since super-ink-repellency is lost from the ink deposited portion, recovery consists of two steps: removal of the ink (including a very small amount of water soluble material) from the surface of the plate 1 and recovery of the super-ink-repellency. These are a step of washing with water and a step of drying. The water washing step is used to remove ink remaining on the surface of the plate 1 and the water soluble material 2. Ink and water soluble material 2 are water-soluble. Thus, a cleaner 6 is used to blow water toward the plate 1 to remove ink and water soluble material 2 from the surface of the plate 1. Drying is then carried out to remove water remaining on the surface of the plate 1. This is carried out by the use of hot air coming from a dryer 7. This recovers the super-ink-repellency on the surface of plate 1, making it possible to start a new image printing process.

Figure 2:
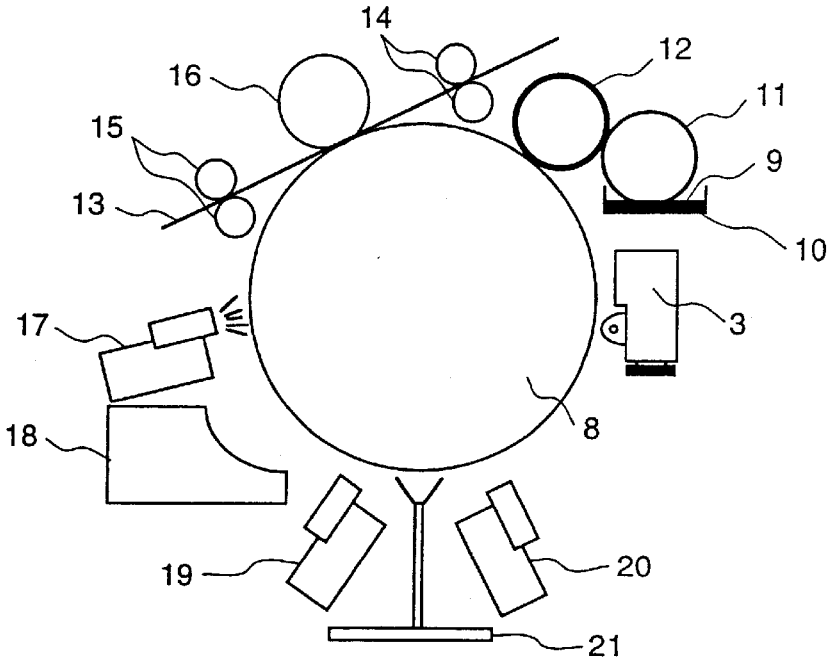
FIG. 2 is a schematic diagram representing the configuration of a printing system according to the present invention.

FIG. 2 is a schematic diagram representing the printer according to the present invention. The processes performed by this printer also flow in the order of formation of a latent image on the plate, development and transfer. The surface of the drum 8 represents a plate where a latent image is formed, and this surface exhibits super-ink-repellency. Formation of a latent image consists of a step of depositing a water soluble material onto the portion of this surface where ink is to be applied. FIG. 2 shows that the water soluble material is ejected from the nozzle of a head 3 for formation of a latent image by an ejecting method to be discussed later and is deposited onto the surface of plate 8. Development consists of a step of applying water-based ink only to the portion of the plate 8 where water soluble material is deposited. Ink 9 is applied to the plate 8 from an ink tank 10 via an ink transporting roll 11 and an ink transfer roll 12. Transfer is a step of shifting onto paper the image formed on the plate 8 by ink 9. Paper 13 is fed to a position between the plate 8 and transfer roll 16 by paper transporting rolls 14 and 15. After the step of transfer is carried out in this position, the paper is fed by the paper transporting rolls 14 and 15. The printing process is now complete. When multiple printed copies having the same image are to be printed, only the steps of development and transfer are repeated since the latent image is already formed on the plate 8 for the second copy and thereafter.

A plate which can be recovered, similar to the organic photoconductor of a laser printer, can be provided by using a mechanism to recover the plate 8. Ink 9 remains on the plate 8 after the printing of a required number of copies has been completed. Furthermore, super-ink-repellency is lost on the ink-deposited portion. Namely, recovery consists of two steps: removal of the ink 9 and recovery of the super-ink-repellency. The recovery includes a step of washing with water and a step of drying. The water washing step is used to remove ink 9 remaining on the surface of plate 8. Ink 9 is water-soluble. Cleaner 17 blows water toward plate 8 to remove ink 9 from the surface of the plate 8. Waste water produced by washing is trapped by a waste water receiver 18. Drying is a step of removing water remaining on the surface of plate 8. This is carried out by hot air coming from a dryer 19. This recovers the super-ink-repellency on the surface of plate 8, making it possible to start a new image printing process. Incidentally, frequent recovery of plate 8 may cause the plate 8 to become hot, so the plate may be cooled by a cooling fan. Furthermore, a wind shield fence 21 can be installed to separate the areas where hot air is provided from the dryer 19 and cold air is provided from the cooling fan 20.

The following describes the members, equipment and mechanism thereof is used in each process.

(1) Overview of plate material

FIG. 1 shows a board-shaped plate (a grip is attached for easy handling). FIG. 2 shows drum-shaped member, but a belt-shaped member also can be used. The plate is designed to have a structure such that the super-ink-repellent surface is formed on a substrate base. When the super-ink-repellent surface is formed, the layer provided to improve close adhesion with the substrate is not subjected to any restriction. In the case of the board-shaped member, a metal such as aluminum, stainless steel and copper is hard to deflect and is less susceptible to breakdown than glass, so it is suitable for use. For the drum-shaped member, the substrate made of aluminum is suitable in terms of resistance to corrosion and density. In addition, iron and copper can be considered, but they are not suitable since they will become gradually corroded in air. Stainless steel poses no corrosion problem, but the density is greater than that of aluminum. This problem is solved by using a thinner plate or a motor of greater torque. In the case of a belt, it is required that the substrate be hard to deflect due to a long-time operation of the printer. Unless there is plasticity, it does not fit with the belt driving roller. In this case, the roller diameter must be increased. When viewed from this viewpoint, polyethylene terephtalate (PET) and polytetrafluoroethylene (PTFE) can be mentioned as materials for use as the substrate. The thickness is set at 20 to 200 microns when the belt driving roller diameter is 5 cm. If a greater thickness is to be used, the roller diameter can be increased.

A super-ink-repellent surface can be formed by applying to the substrate of a board, drum or belt a coating medium forming the super-ink-repellent surface (hereinafter referred to as "super-ink-repellent coating medium" for short). It can also be formed by coating the super-ink-repellent coating medium after the surface of the substrate is roughened. Furthermore, it can be formed by using a substrate made of a fluorine-containing resin, such as PTFE, tetrafluoroethylene - ethylene copolymer (ETFE) and tetrafluoroethylene - hexafluoropropylene copolymer (FEP), and by roughening the surface. Use of a super-ink-repellent coating medium allows a super-ink-repellent surface to be formed by simple steps of coating and heating. This is a great advantage. The following description will indicate how to form a super-ink-repellent surface with a super-ink-repellent coating medium.

(1–2) Super-ink-repellent coating medium

The following description includes details of the super-ink-repellent coating medium and production method thereof. The super-ink-repellent coating medium comprises at least four materials: (1) an ink repellent material to provide super-ink-repellency, (2) fine particles to give irregularities to the super-ink-repellent surface, (3) resin to hold the super-ink-repellent material and fine particles together, and (4) an organic solvent to keep them dissolved and dispersed. These materials are not subjected to any restriction so long as the coated surface exhibits at least super-ink-repellency. The following describes each of these materials:

(1–2–1) Resin

The resin can be epoxy resin, polyimide, glass resin, styrene/acryl resin, polyester or the like without any restriction. However, when the printing resistance is taken into account, it is preferred to use a resin which is capable of being hardened or crosslinked by heat, for example, epoxy resin, melamine resin and glass resin.

(1–2–2) Fine particles

If fine particles are partially or wholly dissolved in the solvent used for the super-ink-repellent coating medium, required irregularities on the super-ink-repellent surface may not be formed, so such fine particles are not preferred. Preferred fine particles are those which are hard to dissolve in a solvent. Such materials are inorganic compounds, such as $SiO_2$, $Al_2O_3$ and $TiO_2$ (oxide is more stable). Furthermore, preferred fine particles also include the ferrite used as a carrier in a copier and printer and the carbon black used as adsorbents. Fine particles should have an average particle diameter of 0.01 to 3 microns. If the diameter is smaller than 0.01 microns, irregularities are hardly formed on the surface. If it is greater than 3 microns, the physical strength of the super-ink-repellent coating medium tends to decrease. Especially, in order to improve the super-ink-repellency, it is preferred to use particles having different average grain sizes. The inventors of the present invention examined this point specifically and have found that the super-ink-repellency on the surface is excellent if the ratio of average grain sizes between fine particles of greater size and those of smaller size is in the range from 50 to 1 through 0001.

(1–2–3) Ink repellent material

Compound containing a long-chained alkyl group and a fluorine compound containing a fluorine atom inside the molecule can be used as ink repellent material. Of these, the fluorine-containing compound is preferred for efficiency in improving super-ink-repellency.

A perfluoroalkyl compound, perfluoropolyether compound and fluoro group substituted aromatic compound are available as a fluorine-containing compound. Of these, the perfluoroalkyl compound and perfluoropolyether compound are more effective to improve super-ink-repellency. When mixed with resin and others to prepare a super-ink-repellent coating medium, the material is preferred to be dissolved into or mixed with the solvent used, because this will ensure uniform distribution when a coated film is formed. However, a perfluoroalkyl compound or a perfluoropolyether compound which has a greater molecular weight has a low solubility into the organic solvent characterized by excellent miscibility with resin (acetone, ethylmethyl ketone, dichloro metal, N, N-dimethylformamide, N-methylpyrrolidone, isophorone, etc.). Thus, solubility into these organic solvents is preferred to ensure bonding of appropriate residue to the end group. Solubility into an organic solvent can be improved by the following means. A hydroxyl group, such as a linear or branched hexanol, octanol, cis- or trans-cyclohexanol and catechol derivatives, is made to react with the material converted into an alcoholate, such as ONa and OK, thereby bonding through an ether bond the alkyl halide material where the end group of a perfluoroalkyl chain or a perfluoropolyether chain is an alkyl halide material, such as $CH_2I$ or $CH_2Br$ (where $CH_2Br$ material has lower reactivity that CH2I material). Furthermore, it is also possible to improve the solubility into an organic solvent as follows. A material having an amino group as the end group (for example, aniline, linear or branched hexylamine, octylamine and decylamine) is made to react with said alkyl halide, thereby achieving bonding it through an amine bond. The material with a perfluoroalkyl chain end group made of alkyl halide includes 2-(perfluoroalbutyl)ethyliodide, 2-(perfluorohexyl)ethyliodide, 2-(perfluorooctyl) ethyliodide, 2-(perfluorodesyl)ethyliodide, 2-(perfluoro-5-methylhexile)ethyliodide, 2-(perfluoro-5-methyloctyl) ethyliodide, 2-(perfluoro-5-methyldesyl)ethyliodide, 2,2,3,3-tetrafluoropropyliodide-1H-1H, 7H-decafluoroheptyldiodide, etc.

Solubility into an organic solvent can also be maintained by the following step. A material having $CH_2OH$ as the end group of a perfluoroalkyl chain or a perfluoropolyether chain is made to react with a material with an end group consisting of alkyl halide (for example, benzylbromide, linear or branched hexylbromide, octylbromide and decylbromide), thereby achieving bonding through an ether bond. Furthermore, solubility into an organic solvent can also be maintained by the following method. A material having a carboxyl group as the end group (benzoate, linear or branched chain, hexyl acid, octyl acid, decyl acid, etc.) is made to react with a material having $CH_2OH$ at the perfluoroalkyl chain or perfluoropolyether chain end group, thereby achieving bonding through an ester bond. The material with a perfluoroalkyl chain or a perfluoropolyether chain end group made of $CH_2OH$ includes 2-(perfluorohexyl)ethanol, 2-(perfluorooctyl)ethanol, 2-(perfluorodesyl)desyl)ethanol, 3-(perfluorohexyl) propanol, 3-(perfluorooctyl)propanol, 3-(perfluorodesyl) propanol, DEMNUM SA by Daikin Kogyo, and FOMBRIN Z-DOL by Augimont. A material based on KRYTOX 157FS by Dupont has its end group made of perfluoropolyether of a carboxyl group. This end group can be reduced by lithium aluminum hydride so as to be converted into $CH_2OH$. Thus, this reduced material can also be used as a material with an end group made of $CH_2OH$.

Solubility into an organic solvent can also be improved by the following step. A material with a perfluoroalkyl chain or a perfluoropolyether chain end group composed of $CO_2H$ is made to react with a material having an amino group as the end group (for example, aniline, linear or branched chain hexylamine, octylamine and decylamine), thereby achieving bonding through an amido bond. Solubility into an organic solvent can also be improved by the following step. A material having a hydroxyl group as the end group (for example, linear or branched chain hexanol, octanol, cis- or trans-cyclohexanol and catechol derivative) is made to react with a material having $CO_2H$ as the end group of a perfluoroalkyl chain or a perfluoropolyether chain, thereby achieving bonding through an amido bond. The material having $CO_2H$ as the end group of a perfluoroalkyl chain or a perfluoropolyether chain includes perfluorohexanoic acid, perfluorooctonic acid, perfluoro decanoic acid, 7H-duodecafluoroheptanoic acid, 9H-hexadecafluorononanoic acid, perfluoroazelaic acid, DEUNUM SA by Daikin Kogyo, FOMBRIN Z-DIAC by Augimont and KRYTOX 157FS-L, 57FS-M and 157FS-H by Dupont.

Solubility into an organic solvent can also be maintained by the following step. A material having an epoxy group as the end group of a perfluoroalkyl chain or a perfluoropolyether chain is made to react with a material having a amino group as the end group and the material having hydroxyl group as the end group, thereby achieving bonding through various forms of bond. The material having an epoxy group as the end group of a perfluoroalkyl chain or a perfluoropolyether chain includes 3-perfluorohexyl-1, 2-epoxypropane, 3-perfluorooctyl-1, 2-epoxypropane, 3-perfluorodecyl-1, 2-epoxypropane, 3-(perfluoro-5-methylhexyl)-1, 2-epoxypropane, 3-(perfluoro-5-methyloctyl)-1, 2-epoxypropane, 3-(perfluoro-5-methyldecyl)-1, 2-epoxypropane, 3-(1H-1H, 7H-decafluoroheptyloxy)-1, 2-epoxypropane, 3-(1H-1H, 9H-hexadecafluorononyloxy)-1, and 2-epoxypropane.

Of the above fluorine-containing compounds, the following ones can be given as compounds which are characterized by a higher solubility into an organic solvent and excellent miscibility with the monomer of epoxy resin as one of the resins used in forming the super-ink-repellent surface, where said compounds promote the formation of a super-ink-repellent surface.

Chemical Formula 1

$$Rf\text{-}(R)_z$$

where Rf has the following structure:

$$F(CF(CF_3)-CF_2-O)_m-CF(CF_3)CONH-$$

$$F(CF_2-CF_2-CF_2-O)_{m'}-CF_2-CF_2-CONH-$$

or $$\underset{\underset{NH}{|}}{OCCF_2O}-[(CF_2-CF_2-O)_n(CF_2-O)_{n'}]-CF_2-\underset{\underset{HN}{|}}{CO}$$

where m, m' and n' are natural numbers

R— has the following structure:

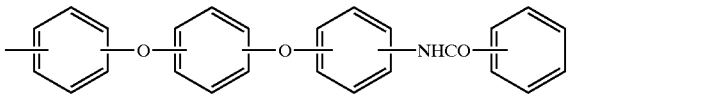

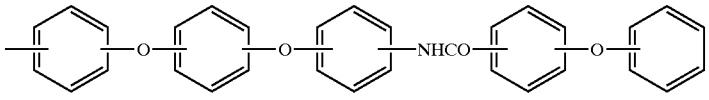

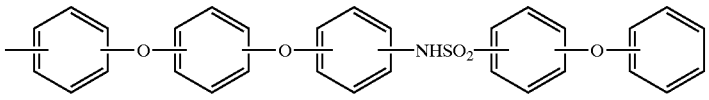

or

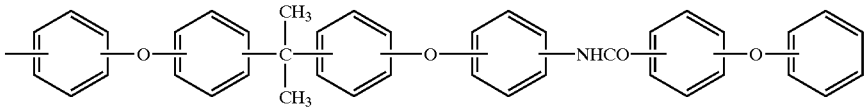

where z is 1 or 2.

Of these compounds, the following ones 1 to 11 are especially preferred because of their excellent miscibility with glass resins in addition to epoxy resins.

Chemical Formula 2

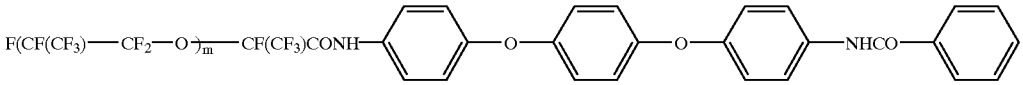

Compound 1

Chemical Formula 3

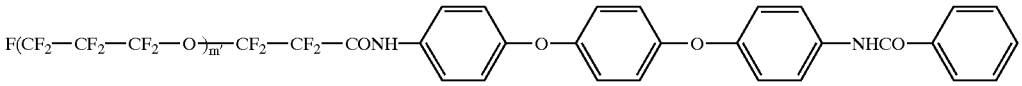

Compound 2

Chemical Formula 4

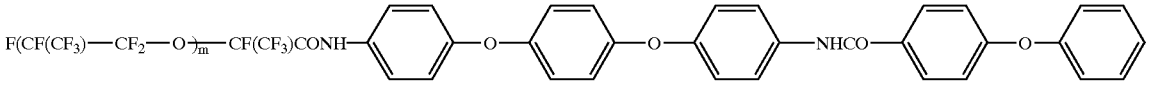

Compound 3

Chemical Formula 5

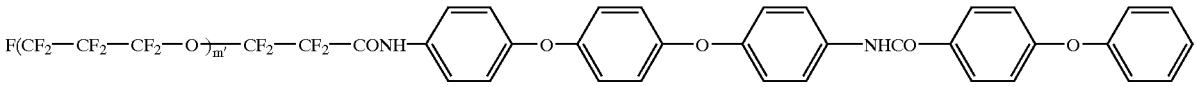

Compound 4

Chemical Formula 9

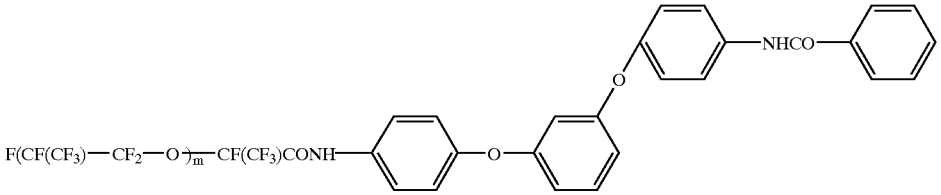

Compound 5

Chemical Formula 7

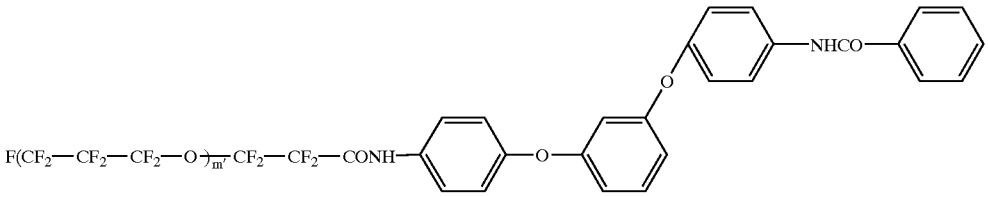

Compound 6

Chemical Formula 8

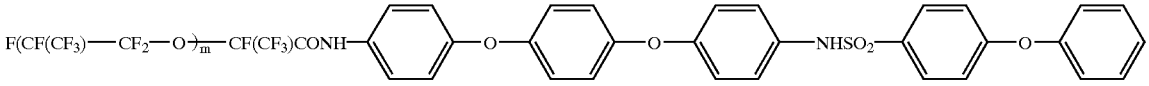

Compound 7

Chemical Formula 9

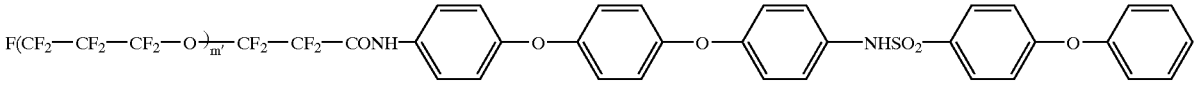

Compound 8

-continued

Chemical Formula 10

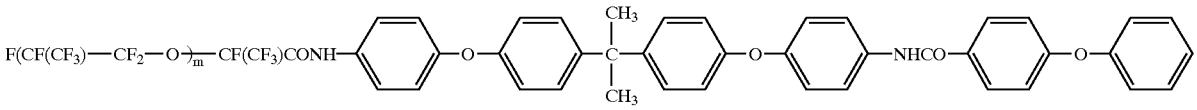

Compound 9

Chemical Formula 11

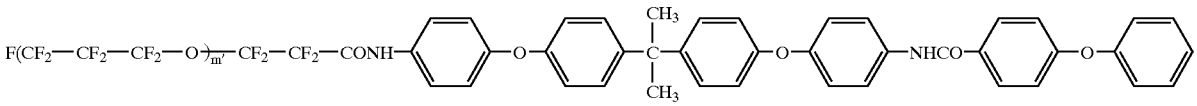

Compound 10

Chemical Formula 12

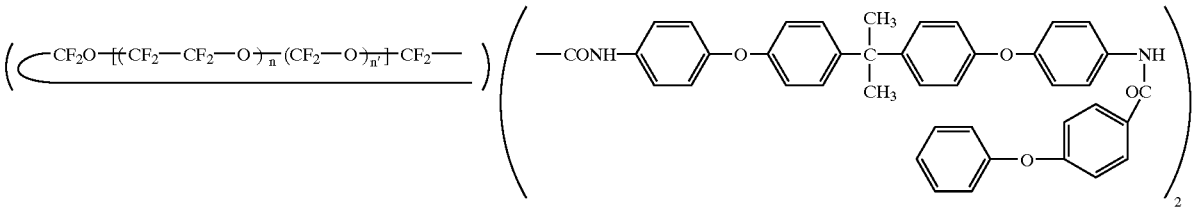

Compound 11

When the average molecular weight of the perfluoropolyether chain is 1500 to 5000 for compounds 1 to 8, 2000 to 9000 for compounds 9 and 10 and 2000 to 5000 for compound 11, the miscibility with a monomer is excellent, and suitability for use is ensured.

Perfluoropolyether chains having a recurring unit of —CF($CF_3$)—$CF_2O$— use KRYTOX 157FS-L, 157FS-M or 157FS-H by Dupont as materials. Those having a recurring unit of —$CF_2CF_2CF_2O$— use DEMNUM SH by Daikin Kogyo as materials. Those with a recurring unit of —$CF_2CF_2O$— and —($CF_2O$)— use FOMBRIN Z-DIAC by Augimont as materials.

The following describes how to synthesize a fluorine-containing compound.

Synthesis of compound 1

KRYTOX 157FS-L by Dupont (average molecular weight: 2500) (25 parts by weight) is dissolved into FC-72 (100 parts by weight) by 3M Co., Ltd., and thionyl chloride (2 parts by weight) and dichloromethane (20 parts by weight) are added to it. The solution is refluxed with agitation for 48 hours. Thionyl chloride and FC-72 are volatilized in an evaporator, thereby obtaining carbonal chloride derivative (25 parts by weight) of KRYTOX 157FS-L.

1,4-bis(4-aminophenoxy)benzene (29 parts by weight) and triethyl amine(25 parts by weight) made by Mitsui Toatsu Chemicals Co., Ltd. are dissolved into dichloromethane (300 parts by weight). While the solution is agitated, benzoyl chloride (14 parts by weight) dissolved into dichloromethane (100 parts by weight) is dripped into the solution for two hours. After that, it is agitated for another 20 hours. The reaction solution is filtrated using filter paper, and the filtrate is concentrated by the evaporator. Then, the solution is separated and refined by column chromatography (WAKOGEL C-200 made by Wako Junyaku Co., Ltd.), thereby obtaining compound 12 (20 parts by weight) having a benzene ring on one side of the amino group.

Chemical Formula 13

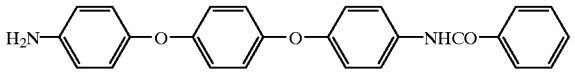

Compound 12

Then, a carbonal chloride derivative (25 parts by weight) of KRYTOX 157FS-L, compound 12 (4 parts by weight), triethyl amine (2 parts by weight) and dichloromethane (20 parts by weight) are added to FC-72 (100 parts by weight), and the solution was refluxed with agitation for 48 hours. The reaction solution is filtrated using filter paper, and the filtrate is left to stand for 12 hours. The dichloromethane layer is removed from the surface, and new dichloromethane (20 parts by weight) is added. After agitation for one hour, it is left to stand for 12 hours. The dichloromethane layer is removed from the surface, and FC-72 in the lower FC-72 layer is volatilized by an evaporator and vacuum pump, thereby getting the intended compound 1 (25 parts by weight).

Synthesis of compound 2

Compound 2 (35 parts by weight) is obtained in a way similar to the method of synthesizing compound 1, except that DEMNUM SH by Daikin Kogyo (average molecular weight: 3500) (35 parts by weight) is used instead of KRYTOX 157FS-L of Dupont (average molecular weight: 2500) (25 parts by weight).

Synthesis of compound 3

Compound 13 (25 parts by weight) is obtained in a way similar to the method of synthesizing compound 12, except that 4-phenoxybenzoyl chloride (23 parts by weight) is used instead of benzoyl chloride (14 parts by weight).

Chemical Formula 14

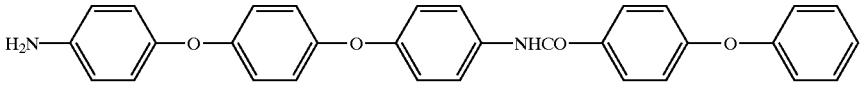

Compound 13

After that, compound 3 (25 parts by weight) is obtained in a way similar to the method of synthesizing compound 1 except that compound 13 (5 parts by weight) is used instead of compound 12 (4 parts by weight).

Synthesis of compound 4

Compound 4 (35 parts by weight) is obtained in a way similar to the method of synthesizing compound 3 except that DEMNUM SH by Daikin Kogyo (average molecular weight: 3500) (35 parts by weight) is used instead of KRYTOX 157FS-L of Dupont (average molecular weight: 2500) (25 parts by weight).

Synthesis of compound 5

Compound 14 (20 parts by weight) is obtained in a way similar to the method of synthesizing compound 12 except that 1,3-bis(4-aminophenoxy)benzene (29 parts by weight) made by Mitsui Toatsu Chemicals Co., Ltd. is used instead of 1, 4-bis(4-aminophenoxy) benzene (29 parts by weight).

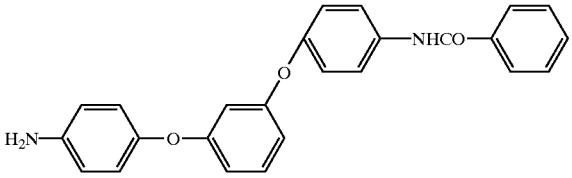

Compound 14

Compound 5 (25 parts by weight) is obtained in a way similar to the method of synthesizing compound 1, except that compound 14 (4 parts by weight) is used instead of compound 12 (4 parts by weight).

Synthesis of compound 6

Compound 6 (35 parts by weight) is obtained in a way similar to the method of synthesizing compound 5, except that DEMNUM SH by Daikin Kogyo (average molecular weight 3500) (35 parts by weight) is used instead of KRYTOX 157FS-L of Dupont (average molecular weight 2500) (25 parts by weight).

Synthesis of compound 7

Compound 15 (21 parts by weight) is obtained in a way similar to the method of synthesizing compound 12, except that 4-phenoxybenzene sulfonyl chloride (18 parts by weight) is used instead benzoyl chloride (14 parts by weight).

Chemical Formula 16

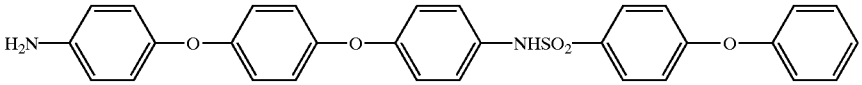

Compound 15

Compound 7 (25 parts by weight) is obtained in a way similar to the method of synthesizing compound 1 except that compound 15 (5 parts by weight) is used instead of compound 12 (4 parts by weight).

Synthesis of compound 8

Compound 8 (35 parts by weight) is obtained in a way similar to the method of synthesizing compound 7 except that DEMNUM SH by Daikin Kogyo (average molecular weight: 3500) (35 parts by weight) is used instead of KRYTOX 157FS-L of Dupont (average molecular weight: 2500) (25 parts by weight).

Synthesis of compound 9

Compound 16 (30 parts by weight) is obtained in a way similar to the method of synthesizing compound 12 except that 2,2-bis[(4-aminophenoxy)phenyl]propane (41 parts by weight) made by Mitsui Toatsu Chemicals Co., Ltd. is used instead of 1, 4-bis(4-aminophenoxy) benzene (29 parts by weight).

[Chemical Formula 17]

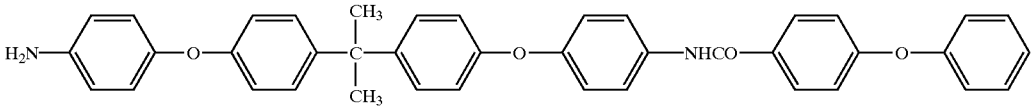

Compound 16

Compound 9 (25 parts by weight) is obtained in a way similar to the method of synthesizing compound 1, except that compound 16 (7 parts by weight) is used instead of compound 12 (4 parts by weight).

Synthesis of compound 10

Compound 10 (35 parts by weight) is obtained in a way similar to the method of synthesizing compound 9, except that DEMNUM SH by Daikin Kogyo (average molecular weight 3500) (35 parts by weight) is used instead of KRYTOX 157FS-L of Dupont (average molecular weight 2500) (25 parts by weight).

Synthesis of compound 11

FOMBRIN Z-DOL by Augimont (average molecular weight 4000) (40 parts by weight) is dissolved in FC-72 (200 parts by weight). N, N-dicyclohexyl carbodiimide (5 parts by weight), compound 16 (13 parts by weight), and dichloromethane (100 parts by weight) are added to it and are agitated for 120 hours. After the reaction solution is filtrated using filter paper, the filtrate is left to stand for 12 hours. The dichloromethane layer is removed from the surface, and FC-72 in the lower FC-72 layer is volatilized by an evaporator and vacuum pump, thereby getting the intended compound 11 (40 parts by weight).

(1–2–4) Super-ink-repellent coating medium production method

The super-ink-repellent coating medium is prepared by sufficient mixing of four materials, including an organic solvent, said ink repellent material, fine particles and resin. Mixing can be made using any of the following appropriate equipment without being restricted to any particulate means: an agitating tool, an agitating rod, an agitating machine and an ultrasonic cleaner. When an agitating machine is used, a great deal of air may be taken in during the coating step. If the substrate of the plate is coated under this condition, air bubbles remain on the coating film surface. When it is dried in this state, irregularities of about 0 to 1 mm will be formed on the surface, and this will reduce the resolution in image formation. In this case, vibration can be applied to coating medium by an ultrasonic cleaner or the like, thereby removing the gas therefrom.

The ink repellent material is coated after roughening the substrate surface as described below.

The following describes a method of forming the super-ink-repellent surface by coating the ink repellent material after roughening the substrate surface. Roughening can be achieved by polishing the surface with sand paper or by a sand blast method. It can also be achieved by applying a coating medium containing fine particles of appropriate size distributed therein. In this case, if the fine particles being used are poorly distributed, improvement must be made by using a surfactant. To put it more specifically, a non-ionic surfactant tends to exhibit greater miscibility with an organic solvent than an ionic surfactant.

Ink repellent material to be coated after roughening includes a compound containing a long-chained alkyl and a fluorine compound containing fluorine atom in the molecule. Of these, the fluorine-containing compound is preferred for improving ink repellency. Furthermore, use of a material capable of making a chemical bond with the surface in addition to providing a mere coating is even more preferred, because it improves the durability as well. The compounds having the following structures can be mentioned.

$$Rf—(CH_2)_3—SI(OR')_3$$

where Rf has the following structure:

$$F(CF(CF_3)—CF_2—O—)_m—CF(CF_3)CONH—$$

or $$F(CF_2—CF_2—CF_2—O—)_{m'}—CF_2—CF_2—CONH—$$

where m and m' are natural numbers

R' is $CH_3$ or $C_2H_5$ $$Rf'—(CH_2)_p—Si(OR')_3$$

Rf'— has the following structure:

$$F(CF_2)_q—$$

$$Rf''—Si(OR')_3$$

Rf''—has the following structure:

$$H(CF_2)_r—$$

where p, q and r are natural numbers

To put it specifically, the following compounds 17 to 25 can be mentioned:

Chemical Formula 19

$$F(CF(CF_3)—CF_2—O—)_m—CF(CF_3)CONH—CH_2CH_2CH_2—Si(OC_2H_5)_3$$

Compound 17

Chemical Formula 20

$$F(CF_2CF_2CF_2—O—)_{m'}—CF_2CF_2CONH—CH_2CH_2CH_2—Si(OC_2H_5)_3$$

Compound 18

Chemical Formula 21

$$F(CF(CF_3)—CF_2—O—)_m—CF(CF_3)CONH—CH_2CH_2CH_2—Si(OCH_3)_3$$

Compound 19

Chemical Formula 22

$$F(CF_2)_6—CH_2CH_2—Si(OC_2H_5)_3$$

Compound 20

Chemical Formula 23

$$F(CF_2)_8—CH_2CH_2—Si(OC_2H_5)_3$$

Compound 21

Chemical Formula 24

$$F(CF_2)_8—CH_2CH_2—Si(OCH_3)_3$$

Compound 22

Chemical Formula 25

$$H(CF_2)_6—Si(OC_2H_5)_3$$

Compound 23

Chemical Formula 26

$$H(CF_2)_{10}—Si(OC_2H_5)_3$$

Compound 24

Chemical Formula 27

$$H(CF_2)_{10}—Si(OCH_3)_3$$

Compound 25 having perfluoroalkyl chain, the compound having a perfluoropolyether chain and the compound having a fluoro group or trifluoro methyl group on the aromatic ring are cited as fluorine-containing compounds. Of these, the compound having a perfluoroalkyl chain and the compound having a perfluoropolyether chain are more effective in improving ink repellency. Furthermore, the compound containing hydrogen as the end group of one side of the perfluoroalkylene chain is also effective.

If the number of q's in the perfluoroalkyl chain is too small, water repellency is reduced. To put it more specifically, the number is preferred to be 3 or more. Water repellency is also reduced if the number of r's in the compound containing hydrogen as the end group of one side of the perfluoroalkylene chain is too small. Specifically, the number is preferred to be 6 or more. Furthermore, water repellency is also reduced if the molecular weight of the compound having a perfluoropolyester chain is too small. The molecular weight is preferred to be 800 or more. The end group of a perfluoroalkyl chain or a perfluoropolyether chain has a trialkoxysilyl group such as a trimethoxysilyl group or a triethoxysilyl group which is a residue to form a chemical bond with the roughened surface. These residues are made to react with a hydroxyl group on the surface by heating, and are fixed on the surface through an oxygen atom. When these compounds are placed in a hot and humid place, trialkoxysilyl group as the end group is vulnerable to hydrolyzation. Thus, these components are preferably stored in a refrigerator. The compound with a trimethoxysilyl group as the end group is more vulnerable to hydrolyzation than the compound with a triethoxysilyl group. When stability in preservation is taken into account, the compound having the triethoxysilyl group as the end group is preferred.

Any of the available spin coat and dip coat methods can be used for coating on the roughened surface of these compounds. Solvent used is preferred to allow the compound to be dissolved therein. Some compounds dissolve in an alcohol based solvent, but they react with water in solution to cause polymerization. This may result in a shorter service life as a coating solution. In this respect, a fluorine based solvent is preferred because water does not easily dissolve in it. In addition, the surface tension of a fluorine-based solvent is small, so the coating solution spreads very thinly over the surface. This provides an advantage in that a thin film can be produced. The fluorine based solvent includes FC-72, FC-77, PF-5080, HFE-7100 and HFE-7200 by 3M Co., Ltd., and VERTREL XF by Dupont.

Of the fluorine-containing compounds listed in the present Specification, compounds 20 to 25 are offered as commercial products from such chemical companies as PCR Incorporated and Daikin Kogyo. The following describes the method of synthesizing the compounds 17 to 19, which represent the remaining fluorine-containing compounds:

Synthesis of compound 17

KRYTOX 157FS-L by Dupont (average molecular weight: 2500) (25 parts by weight) is dissolved into PF-5080 (100 parts by weight) by 3M Co., Ltd., and thionyl chloride (20 parts by weight) is added to it. The solution was refluxed with agitation for 48 hours. Thionyl chloride and PF-5080 are volatilized in an evaporator, thereby obtaining a carbonal chloride derivative (25 parts by weight) of KRYTOX 157FS-L. Then, PF-5080 (100 parts by weight), SAIRA ACE S330 (3 parts by weight) by Chisso Co. and triethylamine (3 parts by weight) are added to it. The solution is agitated for 20 hours at room temperature. The reaction solution is filtrated by RADIOLITE FINEFLOW A by Showa Chemical Industry Co. Ltd., and PF-5080 in the filtrate is volatilized to obtain compound 17 (20 parts by weight).

Synthesis of compound 18

Compound 18 (30 parts by weight) is obtained in a way similar to the method of synthesizing compound 17 except that DEMNUM SH by Daikin Kogyo (average molecular weight: 3500) (35 parts by weight) is used instead of KRYTOX 157FS-L of Dupont (average molecular weight: 2500) (25 parts by weight).

Synthesis of compound 19

Compound 19 (20 parts by weight) is obtained in a way similar to the method of synthesizing compound 17 except that SAIRA ACE S320 (3 parts by weight) by Chisso Co. is used instead of SAIRA ACE S330 (3 parts by weight) by Chisso Co.

(2) Latent image formation system (2–1) Overview

This system is designed to deposit the water soluble material onto the plate, thereby improving the hydrophilic characteristic on the deposited portion. As a result, water-based ink is deposited there to form an image. The step of causing the water soluble material to be deposited is carried out to form a latent image on the plate surface. Consequently, the water soluble material must be in the form of a liquid when it is deposited on the plate. Even if it is a solid, it can be attached to the plate surface by making it into an aqueous solution. Or, even if it is solid, it can be attached to the plate surface by heating and melting. The system of allowing the water soluble material to be attached to the plate includes a method of discharging it from a small-diameter nozzle when the resolution is taken into account (hereinafter referred to as "ejecting method"). This method is preferred in the sense that the resolution can be controlled according to the size and profile of the liquid drops to be ejected. The details of this method will be described later. Furthermore, an image can also be formed by applying the water soluble material to the plate using a felt, brush, cotton, etc. In the case of this method, the resolution is determined by the size of the brush to be used. Thus, improvement of the resolution is more difficult than in the case of said ejecting method.

(2–2) Ejecting method

Figure 3A:
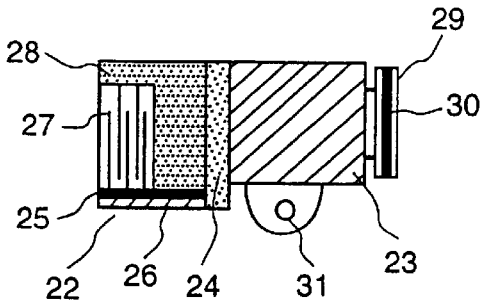
FIG. 3(A) is a cross-sectional view and FIG. 3(B) is a top view of a latent image forming head according to the present invention.
Figure 3B:
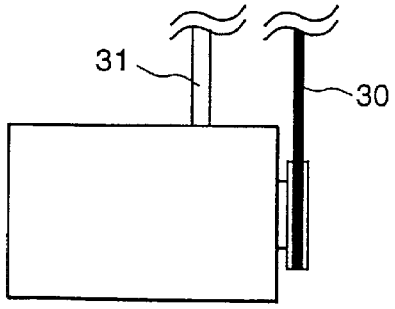

FIGS. 3(A) and 3(B) are schematic diagrams of the device (head for latent image formation) used in the ejecting method. The water soluble material is subjected to pressure by a piezo unit and is ejected from a small-diameter nozzle. The piezo unit applies pressure directly to the water soluble material in response to electric signals. This makes it possible to achieve a high sensitivity to eject the material and to ensure easy regulation of the ejection volume. The following description is directed to the specific operations of the head.

From the nozzle 22 of the head for latent image formation, water soluble material is ejected toward the portion where the ink is to be coated on the plate. The head for latent image formation has a water soluble material supply tank 23. A sponge 24 is fixed on one of the sides of this tank 23. The water soluble material penetrates little by little into the nozzle 22 through this sponge 24 and is spread in the form of a thin film between a certain side of the nozzle and a diaphragm 25 (a thin film 26 of water soluble material in FIG. 3(A). In this case, however, the size of the nozzle 22 is determined to ensure that the substance is ejected only when pressure is applied from the diaphragm 25, with consideration given to the surface tension of the water soluble material. To put it more specifically, it is preferred not to exceed 100 microns. Ejection from the nozzle 22 allows the diaphragm 25 to be deformed in a convex shape toward the side of the nozzle 22 by the piezo unit 27. The diaphragm 25 pushes the thin film 26 of the water soluble material toward the nozzle 22. This is followed by the water soluble material being ejected from the nozzle 22. The operation of the piezo unit 27 is controlled by the piezo unit control system 28. The head for latent image formation is equipped with a pulley 29, and is driven by a belt 30 attached to the pulley 29. Assuming that the direction where the plate rotates is the y-axis direction, then the direction where the head is driven by the belt 30 is the x-axis direction. To give stability to the movement in the X-axis direction, the head is equipped with a guide rail 31.

When the head for latent image formation is configured, the position where the piezo unit 27 applies pressure to the diaphragm 25 is preferably located in the vicinity of the ejection port of the nozzle 22, thereby improving regulation of the ink ejection. The volume and shape of the water soluble material to be ejected varies according to the inner diameter and shape of the nozzle 22 and the distance between the plate and nozzle 22. This requires the piezo unit 27 and these factors to be adjusted while the device is being manufactured. From the result of our experience, we have learned that the resolution can be improved by use of a smaller ejection volume. To put it more specifically, the ejection volume of water soluble material to form one dot is required to be about $1\times10^{-9}$ $cm^3$ in order to get a resolution of 2400 dpi.

During the discharging step, the water soluble material may be deposited on the nozzle 22 and the surrounding area. This problem can be solved to some extent by improving the liquid separation of the nozzle 22. One of the solutions of this problem is to provide a water repellent surface treatment of the nozzle 22 and its vicinity. To put it more specifically, the nozzle and its vicinity are coated with a fluorine-containing compound, such as compounds 17 to 25 according to the present invention, and is heated thereafter.

(2–3) Water soluble material

The water soluble material is first required to be deposited on the plate surface. To meet this requirement, the substance is preferred to have a smaller surface tension. To put it more specifically, the surface tension is preferred to be 50 mN/m or less. The substance is not allowed to swell or melt the plate surface. Furthermore, for the surface of a plate manufactured by use of a super-ink-repellent coating medium, the substance cannot be used if it allows the ink repellent material to be dissolved therein. Of the ink repellent materials, for example, the compounds 1 to 11 cannot be used, since they will dissolve into a ketone based solvent (acetone methylethyl ketone, cyclohexanone, etc.).

In addition, when a highly volatile substance is used, there is a problem in that the latent image disappears before the ink adheres. Such substances include methanol, ethanol, propanol, isopropanol, isobutanol and t-butanol. Furthermore, organic substances containing an amino group, such as an ethylamine, diethylamine, triethylamine and tributylamine, are offensive smelling, and are not practical.

According to our examination, the preferred substances are glycol based compounds, such as ethyleneglycol, diethyleneglycol, triethyleneglycol, tetraethyleneglycol, propylene glycol, ethyleneglycol monomethylether, ethyleneglycol monoethylether, ethyleneglycol monopropylether, diethyleneglycol monomethylether and diethyleneglycol monoethylether. They are less volatile and less offensive smelling.

Further to the above, aqueous solutions of hydrophilic high polymers, such as polyvinyl alcohol, polyethylene imine, polyacrylic acid and polyallylamine can also be used. However, if these polymers have an excessively high concentration, the viscosity will be also high; therefore, a high resistance will occur when the solution is ejected from the nozzle, and so they are hard to eject. Furthermore, if the concentration is too low, the substance is not easily deposited on the plate. The concentration varies according to the type of the resin and the average molecular weight. In the case of polyvinyl alcohol, ejection performances and deposition characteristics are excellent at 3 to 10 wt %. Furthermore, a substance having a greater average molecular weight has a higher viscosity when the concentration is the same; therefore, a lower concentration is preferred. It should be noted that a hydrophilic polymer is a solvent, but the viscosity will be increased when the water evaporates. This makes it hard to eject. Consequently, an organic liquid, such as ethyleneglycol, which can be used in bulk, is preferred to the aqueous solution of a hydrophilic polymer. Table 1 summarizes the characteristics of the water soluble materials we have evaluated.

TABLE 1

Characteristics of water soluble materials used for latent image formation

| Classification | Evaluated water soluble materials | Ejection characteristics (1) | Latent image retention (2) | Odor (3) |
|---|---|---|---|---|
| Glycols | Ethyleneglycol | ○ | ○ | ○ |
| | Diethyleneglycol | ○ | ○ | ○ |
| | Triethyleneglycol | ○ | ○ | ○ |
| | Tetraethyleneglycol | ○ | ○ | ○ |
| | Pentaethyleneglycol | ○ | ○ | ○ |
| | Hexaethyleneglycol | ○ | ○ | ○ |
| | Ethyleneglycol monoethylether | ○ | ○ | ○ |
| | Diethyleneglycol monomethylether | ○ | ○ | ○ |
| | Tetraethyleneglycol monomethylether | ○ | ○ | ○ |
| | Ethyleneglycol mono-n-ethylether | ○ | ○ | ○ |
| | Tetraethyleneglycol mono-n-ethylether | ○ | ○ | ○ |
| | Polyethyleneglycol 200 10 wt % solution | ○ | ○ | ○ |
| | Polyethyleneglycol 2000 5 wt % solution | ○ | ○ | ○ |
| | Polyethyleneglycol 200000 3 wt % solution | ○ | ○ | ○ |
| Alcohols | Methanol | ○ | x | ○ |
| | Ethanol | ○ | x | ○ |
| | n-butanol | ○ | x | x |
| | Poly(vinyl alcohol) (polymerization degree 500) 5 wt % solution | ○ | ○ | ○ |
| | Poly(vinyl alcohol) (polymerization degree 2000) 3 wt % solution | ○ | ○ | ○ |
| Amines | Diethylamine | ○ | x | x |
| | Triethylamine | ○ | x | x |
| | n-butilamine | ○ | x | x |
| | Tri-n-butilamine | ○ | ○ | x |
| | Poly(ethyleneimine) (average molecular weight 1000) 10 wt | ○ | ○ | x |

TABLE 1-continued

Characteristics of water soluble materials used for latent image formation

| Classification | Evaluated water soluble materials | Ejection characteristics (1) | Latent image retention (2) | Odor (3) |
|---|---|---|---|---|
| | % solution | | | |
| | Poly(ethyleneimine) (average molecular weight 10000) 10 wt % solution | ○ | ○ | x |
| Others | Acetone | ○ | x | x |
| | Methylethyl ketone | ○ | x | x |
| | Tetrahydrofuran | ○ | x | x |

(1) Those ejected from the nozzle are marked by "○". Those not ejected or a little ejected are marked by "x".
(2) Those developed 10 minutes after formation of the latent image are marked by "○". Those not developed are marked by "x". Those not ejected from the nozzle are not evaluated since retention force cannot be examined.
(3) "x" is given if the odor of the water soluble material is felt by any one of the randomly selected ten persons. "○" is given if odor is felt by no one.

diameter of 10 microns with an ejection volume of $1\times10^{-9}$ $cm^3$.

(3) Development

Ink is designed to be deposited on the portion of the plate where water soluble material is deposited. The following describes the characteristics of ink required to achieve this, and the system to deposit ink on the plate (development system).

(3–1) Characteristics of the ink

The surface energy of the ink being used must be high enough to ensure that it is not deposited on the portion where the water soluble material of the plate is not deposited. For this reason, a surfactant should not be used for ink wherever possible. The required surface energy varies according to the ink repellency of the plate. Thus, it cannot be determined generally, but ink having a lower surface energy can be used, since the ink repellency of the plate is higher.

When recovery of the plate is taken into account, the ink must be capable of being removed from the plate by washing the plate with water. Consequently, the ink is required to be water-soluble. Furthermore, to ensure effective washing by water, the viscosity of the ink is preferred to be lower. In this case, however, if the viscosity is low, the ink will be splashed, thereby to contaminate the inside of the system when the plate is driven at a high speed. Care must be taken to avoid this.

(3–2) Development system

The system to adhere ink on the plate is designed to ensure that the ink is deposited from the ink tank onto the portion of the plate where the water soluble material is deposited. To cope with a latent image of high resolution, it is important to control the volume of ink to be coated. In FIG. 2, ink is fed to the ink transfer roll 12 from the ink tank 10 via the ink transporting roll 11. A high resolution can also be achieved by controlling the volume of ink 9 to be fed by the ink transporting roll 11.

In order not to damage the latent image comprising the water soluble material, it is preferred to minimize the pressure of the ink coating roll in contact with the plate. In this connection, if the ink has a low viscosity, an adequate amount of ink can be deposited on the plate by dipping the plate directly into the ink tank. An example of this is given in FIG. 1.

(4) Transfer system

Transfer is a step of ensuring that the ink image developed on the plate is transferred to the paper. In this case, slippage between the plate and paper can be avoided by making sure that the peripheral speed of the plate is the same as the speed of the paper transporting roll, thereby preventing the image from being disrupted. A drastic improvement of water resistance can be achieved by laminating a resin on the transferred image surface, even when water-based ink is used for the image.

To get a beautiful image, it is possible use paper which allows ink to penetrate in the direction of the paper thickness, in addition to controlling the transferred volume of ink. Furthermore, concurrent use of the mechanism to heat the transfer roll and the plate surface can also be mentioned as an effective way to ensure quick drying of the ink. To put it more specifically, it is possible to consider use of a heater installed inside the plate or transfer roll to heat the plate or transfer roll surface. In this case, if the surface temperature is controlled so as not to exceed 80 degrees Celsius, an excessive temperature will not occur on the surface, and the ink and water soluble material will be prevented from being dried. This will allow the ink to be effectively transferred to the paper.

If the ink surface tension of the ink on the plate is small, it may be hard to transfer the ink to the paper. In this case, ink transfer can facilitated by exposing the developed plate to a vapor. This is considered to be effective because the vapor is dissolved into the ink to increase the surface tension of the ink, with the result that deposition of the ink on the plate is reduced.

(5) Plate recoverable system

To form a new image on the plate upon completion of transfer, two methods are available: (1) replacement of the plate with a new one, and (2) recovery of the plate according to the process described below. Ink remains on the plate after the printing of a specified number of copies (a very small amount of water soluble material is considered to remain). Moreover, there is no more super-ink-repellency on the ink-deposited area. This means that recovery is a process having two functions, removal of ink and recovery of super-ink-repellency. This process consists of a step of water washing and a step of drying. The following description gives details of this process.

(5–1) Washing with water

Water washing is a step of removing the remaining ink (and a slight amount of water soluble material) from the plate surface. Since the ink is water-soluble, it can be washed away with water. The water outlet should be designed to ensure that water is not applied over the entire plate. A fine net is placed to cover the water outlet so that fine drops of water are applied to the plate, or the outlet is a spray outlet which applies a mist of water to the plate. Both methods are effective. Incidentally, for a printer in which the plate is recovered, a receiving pan must be provided to receive waste water used in the washing of the plate. A concurrent use of the receiving pan and suction fan improves the effect of preventing washing solution from entering the system. Almost all of the waste produced in the washing step consists of water, which can be evaporated or reused by passing it through activated charcoal.

(5–2) Drying

The plate that has been washed with water can be reused after being subjected to drying. Drying is a step of removing water attached to the plate during the water washing process. The plate originally has a super-ink-repellent surface. The super-ink-repellent surface contains fine irregularities and is more difficult to dry than a flat plate. In this case, it is effective to blow hot air onto the plate surface. In this way, water drops are blown away by hot air, and the very small amount of remaining water is evaporated, thereby ensuring quick drying. To ensure quick evaporation of the water, the water is preferred to have a temperature of 120 degrees Celsius or more. In this case, however, the maximum temperature of the hot air must be kept below the heat resistant temperature of the super-ink-repellent surface. Furthermore, it is also possible to use a heat roll of the type used in the toner fixing step of a laser printer and copier. In this case, the maximum temperature of hot air must also be kept below the heat resistant temperature of the super-ink-repellent surface.

What is more, almost all of the water can be removed by blowing high pressure air against the plate surface with an air compressor. Use of this method will reduce the time in the subsequent step of heating the plate using hot air and will also save energy resulting from a reduced hot air temperature.

If the plate is excessively heated in the drying step, a problem occurs that the ink deposited in the ensuing development step is dried up before transfer. To avoid this, the plate may have to be cooled before formation of the next latent image. Use of a fan is effective in cooling, since it ensures a uniform cooling of the entire plate surface. In this case, installation of a wind shield fence is preferred to keep down the effect of the hot air from the dryer. This will ensure effective drying of the plate by a dryer and cooling of the plate by a cooling fan.

Super-ink-repellency on the plate surface is recovered by going through said processes, and a new image printing process can be started.

The image forming method and printer according to the present invention ensures that ink on the surface of the plate characterized by super-ink-repellency is deposited on a desired portion by depositing a water soluble material, with the result that a latent image is formed. In the ensuing development step, water-based ink is deposited only on the portion where water soluble material is attached, and not on the portion where water soluble material is not attached. Then, a developed image is transferred on the paper, thereby completing the entire printing step. When the identical image is to be created in multiple copies, the latent image formation step is omitted, and only the development and transfer steps are implemented. Plate recovery can be achieved by removal of remaining ink by washing the plate with water and drying the plate using heat and forced air. This facilitates formation of a plate and allows the plate to be recovered. Furthermore, this has made it possible to provide an image formation method by using a water-based ink and printer. The following Embodiments describe applications of the present invention specifically, but the present invention is not restricted to such Embodiments.

Embodiment 1

The following description is directed to a method of producing a super-ink-repellent coating medium used when the plate is formed. Epoxy resin (EPL004) (44 parts by weight) by Yuka Shell Epoxy Kabushiki Kaisha, phenol resin (MARUKA LYNCUR M) (30 parts by weight) by Maruzen Petrochemical Co., Ltd. and catalyst (trade name: TEA-K) (1 part by weight) by Hokko Kagaku K. K. are dissolved into a solvent consisting of a mixture between ethylmethyl ketone (950 parts by weight) and ethyleneglycol acetate mono-n-butyl ether (50 parts by weight). Then, the compound 1 (2 parts by weight) as fluorine-containing compound is added to it and is agitated sufficiently. Then, AEROSIL 130 (average grain size: about 16 nm) (8 parts by weight) by Nihon Aerosil Co., Ltd. and NIPSILE-220A (average grain size: about 1.5 microns) (8 parts by weight) by Nippon Silica Industries Co., Ltd. are added and agitated sufficiently, thereby producing the super-ink-repellent coating medium.

The following description is directed to the manufacture of the plate. A 1 mm-thick aluminum board 1 (20×20 mm) having an L-shaped grip (one side: 5 mm), as seen in FIG. 1, is dipped in said super-ink-repellent coating medium for ten seconds. Then, the board is pulled up at a speed of 3 cm/sec. This board is heated at a temperature of 120 degrees Celsius for 30 minutes, then at 180 degrees Celsius for 45 minutes. After the board is cooled down to normal temperature, the portion of the board, where the super-ink-repellent coating medium adheres, exhibits super-ink-repellency. Thus, a plate is produced from a board as a substrate.

A latent image is formed on this plate by discharging ethyleneglycol as a water soluble material 2 from the head for latent image formation 3 onto this plate, as shown in step (A) of FIG. 1. Ethyleneglycol is infinitely diluted in water. The ejecting head 3 has an inner diameter of 10 microns with an ejection volume of $1\times10^{-9}$ $cm^3$. In this way, it is possible to manufacture a printing plate for the printer using water-based ink. Incidentally, the diameter of the minimum dot in the latent image is 12 microns.

To determine if this plate could function as a printing plate, the inventors of the present invention tried to carry out development and transfer of an image on paper. The plate was dipped into water-based ink in the pad 4 shown in FIG. 1. Ink was deposited only onto the portion where the water soluble material 2 was attached, with the result that a latent image was developed by the ink. Then, the developed image was brought in contact with paper 5. This resulted in ink on the plate being transferred onto the paper 5. Incidentally, the minimum dot size of the transferred image was 10 microns.

The above experiment made it clear that the printing plate in this Embodiment satisfactorily functions as a printing plate of the printer where an image is formed by using water-based ink. When an identical image was created in multiple copies, the latent image formation step was omitted for the second copy and thereafter, and an image could be formed merely by development and transfer.

Then, after transfer, distilled water was sprayed onto the surface of the plate by the cleaner 6, thereby ensuring that the remaining ink was washed away, as shown in step (D) of FIG. 1. After that, hot air was applied for 30 seconds by a dryer 7 (power consumption: 1000 W) to dry the plate, as shown in step (E). After drying, the plate again exhibited super-ink-repellency. Using this plate, steps (A) to (C) of FIG. 1 were performed again. As a result, the same image as the above could be obtained.

The above description has made it clear that the printing plate according the present Embodiment can be recovered by washing and drying. That the plate can be recovered means that the plate can be used repeatedly. It has the effect of cutting down the cost of the plate used in the printing.

Reference Example 1

Using the same aluminum board as that used in Embodiment 1, except that the super-ink-repellent coating medium is not coated thereon, the inventors of the present invention tried to form an image and to recover the plate, as shown in steps (A) to (E) of FIG. 1. However, in order to develop a latent image after formation thereof, the authors dipped the plate in the pad containing water-based ink and found out that ink was deposited on almost the entire surface of the plate. Namely, development in conformance with the latent image could not be achieved. Thus, the desired printing could not be achieved by transferring this image. This has revealed that formation of an image by the printing plate according to the present invention requires the plate to have super-ink-repellency.

Reference Example 2

Using the same aluminum board as that used in Embodiment 1, except that rape-seed oil instead of ethyleneglycol was used as a water soluble material, the inventors of the present invention tried to form an image and to recover the plate, as shown in steps (A) to (E) of FIG. 1. Incidentally, after rape-seed oil and water are mixed in the same amounts and are agitated, if the solution is left to stand, the oil and water will become separated in two layers. Namely, rape-seed oil hardly dissolves in water, not to mention infinite dilution. This shows that rape-seed oil does not comprise a water soluble material according to the present invention. After formation of a latent image, development and transfer, the plate was washed with water, and was then dried, similarly to the case of Embodiment 1. The latent image of rape-seed oil remained on the surface of the plate. The portion where the rape-seed oil of the plate was attached did not exhibit super-ink-repellency. Thus, formation of a latent image, development and transfer were tried again using this plate. Part of the previous image was overlapped on that image.

This has revealed that formation of an image by the printing plate according to the present invention requires a water soluble material to be used when a latent image is to be formed.

Embodiment 2

The following description is directed to Embodiment of a printer where a printing plate mechanism is built in. First, it will be indicated how to manufacture the plate to be used. An aluminum sleeve having an outer diameter of 20 cm and a length of 22 cm is dipped in the super-ink-repellent coating medium prepared in Embodiment 1 and is then pulled up at a speed of 3 cm/sec. This aluminum sleeve is heated at a temperature of 120 degrees Celsius for 30 minutes, and then at 180 degrees Celsius for 45 minutes. After the aluminum sleeve is cooled down to normal temperature, the portion of the aluminum sleeve where the super-ink-repellent coating medium is deposited exhibits super-ink-repellency. Thus, a plate is produced from an aluminum sleeve as a substrate.

After this plate is mounted on a device as shown in FIG. 2, the device is operated as a printer. First, a latent image is formed on the plate 8. The image is developed and is finally transferred. This process will be described below.

Latent image forming step: Ethyleneglycol as one type of water soluble material is ejected from the head 3 for latent image formation toward the portion of the plate where ink is to be deposited. The water soluble material ejecting head has an inner diameter of 10 microns with an ejection volume of $1\times10^{-9}$ $cm^3$. The minimum dot size of the latent image formed on the plate comprises a diameter of 12 microns.

Development step: After formation of the latent image, plate 8 is brought in contact with ink 9. Ink 9 is deposited only on the area where water soluble material is attached. Ink 9 is located in an ink tank 10 and is fed to an ink transfer roll 12 by an ink transporting roll 11, so that the ink is coated on the plate 8 from the ink transfer roll 12. The surface of the ink transfer roll 12 is wound with a fine-meshed sponge.

Transfer step: In this step, ink 9 is transferred onto paper 13 from the plate coated with ink. Paper 13 is fed between transfer roll 16 and plate 8 through paper transporting rolls 14 and 15. The distance between paper 13 and plate 8 is adjusted to a proper value by the paper transfer rolls 14 and 15. After transfer, paper 13 is removed from the plate 8 by means of paper transporting roll 15.

Through the steps described above, the printer according to this Embodiment is able to form an image using water-based ink. The diameter of the minimum dot in the transferred image was 10 microns. When the identical image was created in multiple copies, the latent image formation step was omitted, and only the development and transfer steps were implemented successively.

The following description is directed to the recovery of the plate 8 in the printer in the present Embodiment. This process consists of a water washing step and a drying step.

Water washing step: This is a step of removing ink from the surface of the plate. Ink 9 is water-soluble. Cleaner 17 blows water toward plate 8 to remove ink 9 from the surface of the plate 8. Waste water produced by the washing is trapped by a waste water receiver 18. Drying is a step of removing any water remaining on the surface of plate 8.

Drying step: This is a step of drying the plate 8 that has been wet by washing with water, thereby ensuring recovery thereof. This step uses hot air coming from the dryer 19. This step recovers the super-ink-repellency on the surface of the plate 8 and allows the printing the new images to be started. Frequent recovery of the plate 8 will heat the plate, so the plate is cooled by a cooling fan 20. Furthermore, a wind shield fence 21 is installed to separate the hot air from the dryer 19 and cold air from the cooling fan 20.

Upon completion of the above steps, the entire process of recovering the plate in the printer according to the present Embodiment is complete. Using the recovered plate 8, the inventors of the present invention again performed formation of a latent image, development and transfer, and succeeded in printing a required image on paper.

This experiment has verified that the device according to the present Embodiment is a printer equipped with a recovery function. Recovery of a plate signifies the capability of repeated use of the plate and hence a reduced cost of the plate in printing.

Reference Example 3

On the device illustrated in FIG. 2, the inventors of the present invention mounted the same aluminum sleeve as that in Embodiment 2, except that the super-ink-repellent coating medium is not coated thereon, and then tried to form an image and to recover the plate. After formation of a latent image, water-based ink was brought in contact with the plate for development. The result was that ink was deposited on almost the entire surface of the plate. Namely, development according to the latent image failed; therefore, a desired image could not be obtained when the ink was transferred to paper. This shows that the image forming surface is required to have super-ink-repellency in order to form an image with the printer according to the present invention.

Reference Example 4

Using the same device as that in Embodiment 2, except that rape-seed oil instead of ethyleneglycol was used as a water soluble material, the inventors of the present invention tried to form an image and to recover the plate. As described in the explanation of Reference Example 2, rape-seed oil is not a water soluble material according to the present invention.

The surface of the plate was examined after completing one cycle of the steps of latent image formation, development, transfer, washing and drying, and the latent image of remaining rape-seed oil was observed on the surface. The portion of the plate where rape-seed oil was attached did not show super-ink-repellency. A new cycle of latent image formation, development and transfer steps was carried out using this plate. Part of the previous image was overlapped on the new image.

This verifies that formation of an image by the printer according to the present invention requires use of a water soluble substance when the latent image is formed.

Embodiment 3

Figure 4:
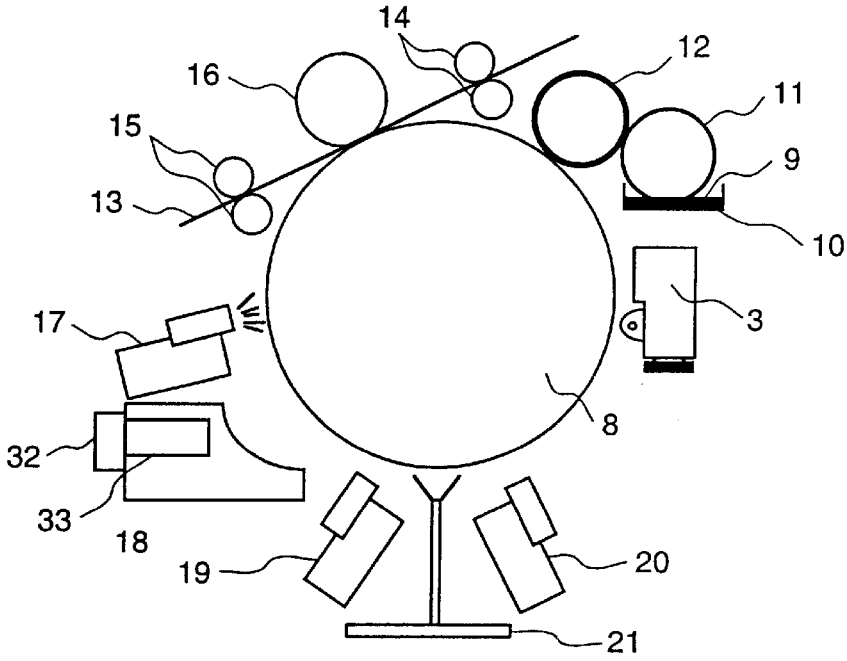
FIG. 4 is a schematic diagram representing the configuration of a printing system according to the present invention.

When repeated recovery of the plate by the device discussed in Embodiment 2 was carried out, a very small portion of waste water (about 1 percent of the entire waste water) splashes around the waste water receiver to contaminate the inside of the system. The remaining 99 percent entered the waste water receiver. Thus, the device mentioned in Embodiment 2 was improved to include a suction fan 32 to suck cleaning solution into the waste water receiver 18 and a suction nozzle 33, as shown in FIG. 4.

Almost all of the waste water (about 99.9 percent of the entire waste water) can be trapped into the waste water receiver by operating this system. This demonstrates the effect of avoiding contamination caused by contaminants due to waste water inside the system. This system ensures the same printing as that of Embodiment 2, as well as recovery of the plate.

Embodiment 4

Figure 5:
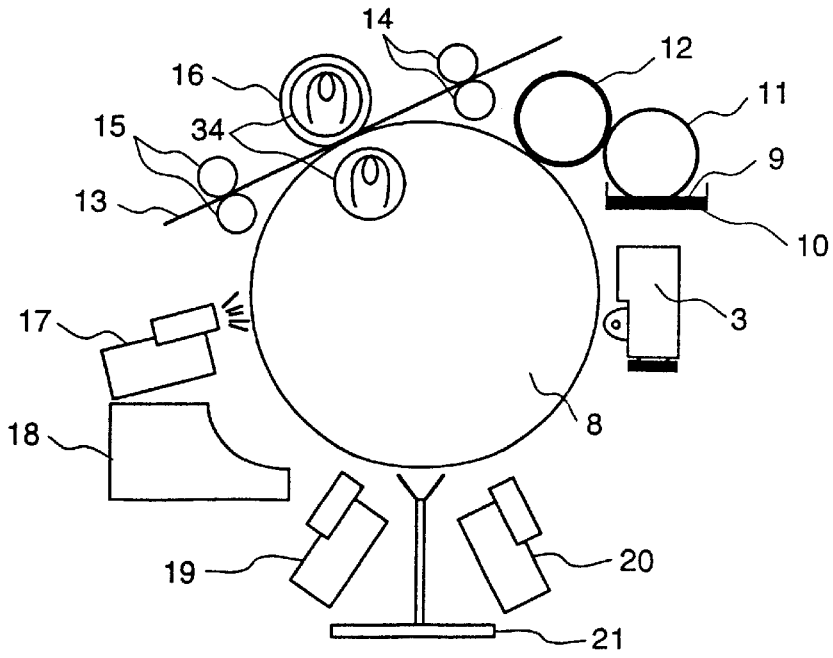
FIG. 5 is a schematic diagram representing the configuration of the printing system according the present invention.

Water-based ink is used in the system according to the present invention. To promote quick drying of ink on paper, an incandescent lamp 34 (100 W) is provided in the vicinity of the transfer area inside the transfer roll and inside the plate, as shown in FIG. 5. The transfer roll and plate were heated by heat generated by this incandescent lamp, and the ink on paper dried up quickly during the transfer process.

Immediately after printing, the image was touched by hand, but ink was not transferred to the hand. This shows that handling of the printed matter immediately after printing is much facilitated by adding a heating mechanism to the transfer mechanism. This system ensures the same printing as that of Embodiment 2, as well as recovery of the plate.

Embodiment 5

The same operations as in Embodiment 2 were performed, except that ethyleneglycol was replaced by ethyleneglycol monomethylether as the water soluble material. It has been made clear as a result that this system ensures the same printing as that of Embodiment 2, as well as recovery of the plate. It should be noted that ethyleneglycol monomethylether is infinitely diluted in water.

Embodiment 6

The same operations as in Embodiment 2 were performed except that ethyleneglycol was replaced by diethyleneglycol as the water soluble material. It has been made clear as a result that this system ensures the same printing as that of Embodiment 2, as well as recovery of the plate. It should be noted that ethyleneglycol is infinitely diluted in water.

Embodiment 7

The same operations as in Embodiment 2 were performed, except that ethyleneglycol was replaced by tetraethyleneglycol as the water soluble material. It has been made clear as a result that this system ensures the same printing as that of Embodiment 2, as well as recovery of the plate. It should be noted that tetraethyleneglycol is infinitely diluted in water.

Embodiment 8

The same operations as in Embodiment 2 were performed, except that ethyleneglycol was replaced by 5% poly(vinyl alcohol) (by Wako Junyaku Co., Ltd. with degree of polymerization about 500) aqueous solution as the water soluble material. It has been made clear as a result that this system ensures the same printing as that of Embodiment 2, as well as recovery of the plate. It should be noted that 5% polyvinyl alcohol aqueous solution is infinitely diluted in water.

Embodiment 9

Instead of using an aluminum sleeve with a coating film of super-ink-repellent coating medium as a plate, a plate having tetrafluoroethylene-ethylene copolymer (hereinafter referred to as "ETFE" for short) on the surface was manufactured. It was mounted on the same system as that in Embodiment 2, and the same operations as in Embodiment 2 were performed. It has been made clear as a result that this system ensures the same printing as that of Embodiment 2, as well as recovery of the plate. The following description indicates how to manufacture the plate according to the present Embodiment.

First, a 0.5 mm thick ETFE sheet is pressed against the outside of the 3 mm thick stainless steel sleeve having an inner diameter of 20 cm. Its surface is roughened using a belt sander (M648) by Kikugawa Iron Works. In this experiment, a #240 belt was used. Then, this sleeve is cleaned using an ultrasonic cleaner, and chips produced by roughening are removed. Cleaning solvent used in this experiment was PF-5080 by 3M Co., Ltd. In this way, a plate having ETFE on the surface was manufactured.

Embodiment 10

Instead of using an aluminum sleeve with a coating film of super-ink-repellent coating medium as a plate, a plate having tetrafluoroethylene-hexafluoropropylene copolymer (hereinafter referred to as "FEP" for short) on the surface was manufactured. It was mounted on the same system as that in Embodiment 2, and the same operations as in Embodiment 2 were performed. It has been made clear as a result that this system ensures the same printing as that of Embodiment 2, as well as recovery of the plate. The plate manufacturing method is the same as that in Embodiment 9, except that FEP is used instead of ETFE.

The above description uses paper as an object to be printed. The object to be printed is not limited to paper; it is possible to print on a great variety of objects including glass, plastic, metal, wood and cloth. It is also possible to provide coating in advance in conformance to the ink to be used on the surface of the object to be printed.

The present invention facilities formation of a plate and provides a printing system capable of regenerating the plate, and a press plate.

What is claimed:

1. A printing plate used in a printer to form an image using water based ink wherein a printed image on paper is formed by the steps of forming a latent image on the printing plate, developing the latent image and transferring the developed image to the paper, the printing plate having a surface on which the latent image is to be formed, the surface of the printing plate being super-repellant to the water based ink to be used and being adhesive to water soluble material used for forming the latent image, the surface of the printing plate being responsive to application of the water soluble material thereon so as to have the water soluble material adhere onto the surface of the printing plate in accordance with the latent image which is formed, the surface of the printing plate being responsive to application of the water based ink so aas to develop the latent image by adhering the water based ink onto only portions of the surface of the printing plate where the water soluble material is adhered, the surface of the printing plate being responsive to the paper applied thereto for transferring the developed image to the paper by transferring the water based ink adhered onto only the portions of the surface of the printing plate onto the paper, and the surface of the printing plate, after completion of transfer of the developed image onto the paper, being responsive to washing with water and subsequent drying so that the printing plate is recoverable as a re-usable printing plate, wherein the water soluble material has a surface tension no greater than 50 mN/m.

2. A printer utilized for printing an image on paper, the image being formed by the steps of forming a latent image on the plate, developing the latent image, and transferring the developed image onto the paper, the printer comprising at least:

(1) a plate;

(2) a mechanism forming a latent image on the plate;

(3) a mechanism to develop the latent image utilizing a water based ink;

(4) a mechanism to transfer the developed image onto the paper;

the plate having a surface which is super-repellant to the water based ink to be used and which is adhesive to water soluble material used for forming the latent image;

the surface of the plate being responsive to the water soluble material applied thereto for adhering the water soluble material onto the surface of the plate in accordance with the latent image;

the surface of the printing plate being responsive to the application of the water based ink for developing the latent image by adhering the water based ink onto only portions of the surface of the plate where the water soluble material is adhered;

the surface of the plate being responsive to the paper for transferring the developed image to the paper by transferring the water based ink adhered onto only the portions of the surface of the plate to the paper; and (5) a mechanism to recover the plate as a re-usable printing plate after completion of the transfer of the developed image to the paper, the mechanism containing at least a device to remove the water based ink adhered onto the plate and a device to dry the plate;

wherein the water soluble material has a surface tension no greater than 50 mN/m.

3. A printer according to claim 2, further comprising a mechanism to heat at least one of the plate and the transfer mechanism.

4. A printer according to claim 3, wherein the heat mechanism is provided at least one of inside of the plate and inside of the transfer mechanism.

5. A printer according to claim 2, wherein the device to remove ink adhered onto the plate is a washing device for washing the plate with water, and further comprising a mechanism to suck waste water generated by the washing device washing the plate.

6. A printing method for forming images with water based ink by a printing apparatus comprising a printing plate, having a surface which is super-repellant to the water based ink to be used and adhesive to water soluble material used for forming a latent image thereon comprising the steps of:

forming a latent image by adhering the water soluble material onto the surface of the printing plate;

developing the latent image by adhering water based ink onto only portions of the surface of the printing plate where the water soluble material is adhered;

transferring the developed image onto a paper by transferring the water based ink adhered onto only the portions of the surface of said printing plate to the paper; and recovering the printing plate as a re-usable printing plate after completion of the transferring step by removing ink adhered onto the portions of the surface of the printing plate where the water soluble material is adhered, and drying the printing plate;

wherein the water soluble material has a surface tension no greater than 50 mN/m.

* * * * *